US008240390B2

(12) United States Patent
Hendrickson et al.

(10) Patent No.: US 8,240,390 B2
(45) Date of Patent: Aug. 14, 2012

(54) METHOD AND APPARATUS FOR RELEASING A PACKER

(75) Inventors: James D. Hendrickson, Sugar Land, TX (US); Baozhong Yang, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 227 days.

(21) Appl. No.: 12/649,422

(22) Filed: Dec. 30, 2009

(65) Prior Publication Data

US 2011/0155395 A1 Jun. 30, 2011

(51) Int. Cl.
*E21B 23/00* (2006.01)

(52) U.S. Cl. ..... 166/377; 166/118; 166/134

(58) Field of Classification Search ..... 166/377, 166/387, 118, 134
See application file for complete search history.

(56) References Cited

U.S. PATENT DOCUMENTS

| | | | | |
|---|---|---|---|---|
| 3,211,227 | A * | 10/1965 | Mott | 166/120 |
| 3,306,102 | A | 2/1967 | Lebourg | |
| 5,400,855 | A | 3/1995 | Stepp et al. | |
| 6,651,750 | B2 | 11/2003 | Whitsitt | |
| 7,284,619 | B2 | 10/2007 | Stokley et al. | |
| 8,061,429 | B2 * | 11/2011 | Du et al. | 166/377 |
| 2005/0126787 | A1 | 6/2005 | Gomez | |

* cited by examiner

*Primary Examiner* — William P Neuder
(74) *Attorney, Agent, or Firm* — Rodney Warford; Tim Curington; William Ryann

(57) ABSTRACT

Disclosed herein are methods and apparatus for releasing a releasable packer. The apparatus may include shear screws, a mechanism for isolating the shear screw from a shearing force. The mechanism for isolating the shear screw from a shearing force is selectively unlockable to expose the shear screw to the shearing force. The methods may include unlocking a mechanism protecting at least one shear screw, applying a shearing force to the at least one shear screw, and shearing the at least one shear screw.

9 Claims, 3 Drawing Sheets

METHOD AND APPARATUS FOR RELEASING A PACKER

BACKGROUND

Packers and plugs may be run into a wellbore (cased or uncased) to hydraulically isolate the sections above and below the packer and to provide a mechanical anchor to prevent the packer from sliding inside the wellbore. Packers may be set, e.g., mechanically, hydraulically, or on wireline. A mechanical-set packer may be set by applying either tension or compression on the packer. Upon setting, in many instances, an anchor or slip is biased outward towards the casing to anchor the packer. A packer forms a seal for purposes of, e.g., controlling production, injection or treatment. The packer is preferably lowered downhole into the well in an unset state. However, once in the appropriate position downhole, the packer is preferably set from the surface of the well. As an example, for a mechanically-set packer, a tubular string that extends from the surface to the packer may be moved pursuant to a predefined pattern to set the packer. In its set state, the packer anchors itself to the casing wall of the well and forms a seal in the annular region between the packer and the interior surface of the casing wall. This seal subdivides the annular region to form an upper annular region above the packer that is sealed off from a lower annular region below the packer. The packer typically includes at least one seal assembly to form the annulus seal and at least one set of slips to anchor the packer to the casing string. When run into the well, the seal assembly and the slips are radially retracted to allow passage of the packer through the central passageway of the casing string. After a particular job is complete, the slips and seals may be again retracted, allowing the packer to be removed or moved to another location in the well.

A straight pull release (SPR) mechanism is a preferred mechanism for retracting the seals and/or the slips to retrieve a packer, because it does not require the use of additional equipment or service tools to retrieve the packer. SPR mechanisms are often realized by a group of shear screws which are directly loaded by tensile forces and pressure-induced hydrostatic forces. Therefore, the tensile rating and pressure rating of the SPR packers are frequently limited by the shear strength of these screws. Therefore it may be desirable to protect these shear screws to prevent premature release.

SUMMARY

Disclosed herein are methods and apparatus for releasing a releasable packer. The apparatus may comprise shear screws, means for isolating the shear screw from tensile force and wherein the means for isolating is selectively unlockable to expose the shear screw to the force.

The methods may comprise unlocking a mechanism protecting at least one shear screw, applying a shearing force to the at least one shear screw, and shearing the at least one shear screw.

DETAILED DESCRIPTION

As used herein, the terms up and down and above and below are used for ease of relative reference. However, it is intended that the packers described herein may be used in any spatial position.

Figure 1:
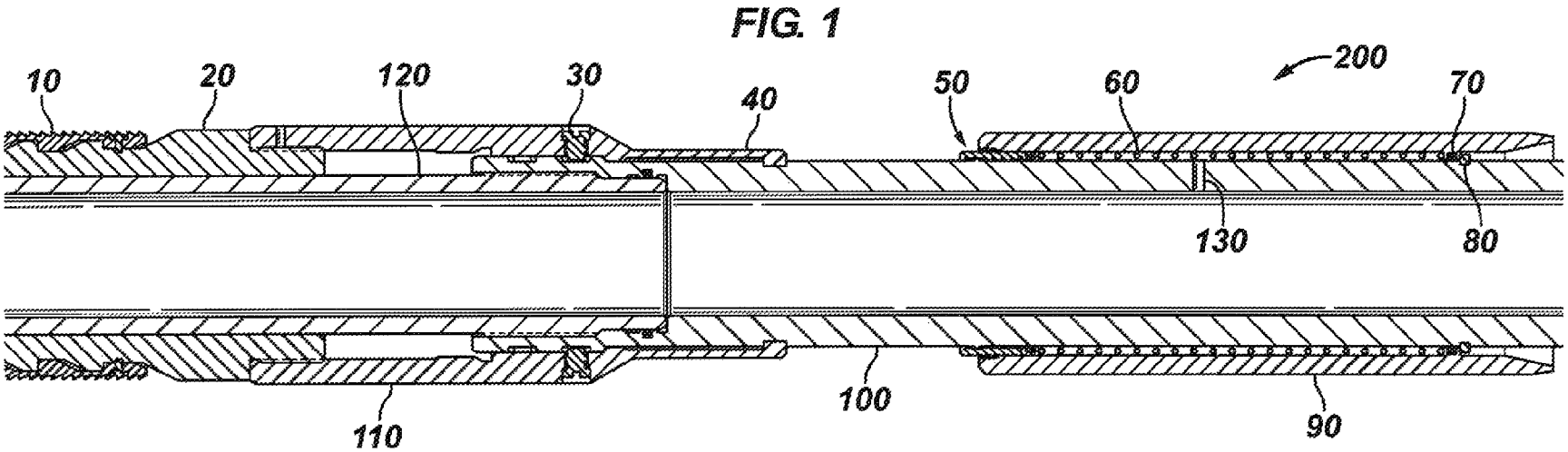
FIG. 1 is a drawing of an exemplary embodiment of an SPR packer as described herein.

There is shown in FIG. 1, an SPR packer comprising an anchor 10 (also called a slip), a lower cone 20, shear screws 30, collet fingers 40, O-ring container 50, spring 60, O-ring 70, stop ring 80, holding collar 90, bottom mandrel 100, gage ring 110, mandrel 120, and port 130

In operation, in general, disclosed herein is a mechanism to protect SPR shear screws 30 and release this protection mechanism only when it is desirable to release the packer. Generally, an SPR packer as disclosed herein preferably allows the packer to achieve a higher pressure and tensile rating without comprising its ability to be set or be retrieved when required. Preferably, the SPR shear screws are protected when the annulus pressure is larger (to some threshold value) than the tubing pressure. It is not necessary that the shear screws 30 are protected when there is no pressure differential between the annulus and the tubing or when the tubing pressure is larger than the annulus pressure because the danger of premature shearing of the screws is minimal.

In operation, when there is no pressure differential between the tubing and the annulus, spring 60 is at its free or unloaded length, the holding collar 90 is disengaged with collet fingers 40.

After the packer is set (and slips 10 are engaged), the tensile force and hydrostatic forces induced by pressure below (from pressure downward for a horizontal completion) will be loaded on the shear screws if the screw protection mechanism is not in place. When the pressure below reaches some threshold value (in applications like gravel packing, frac-packing, etc.), the combined tensile force may be large enough to shear the shear screws undesirably.

Figure 2:
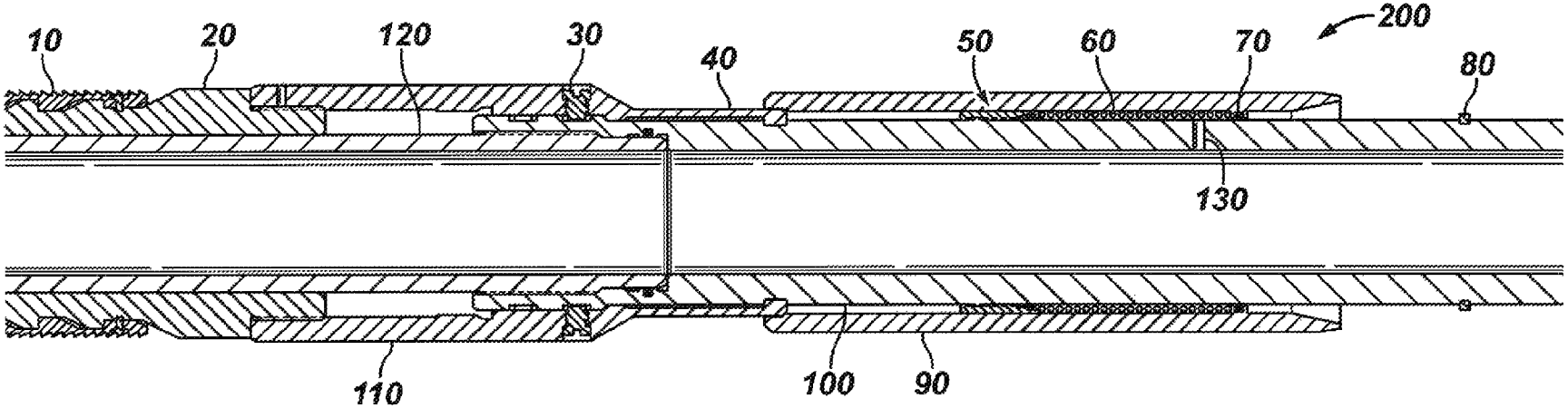
FIG. 2 is a drawing of an exemplary embodiment of an SPR packer as described herein.
Figure 3:
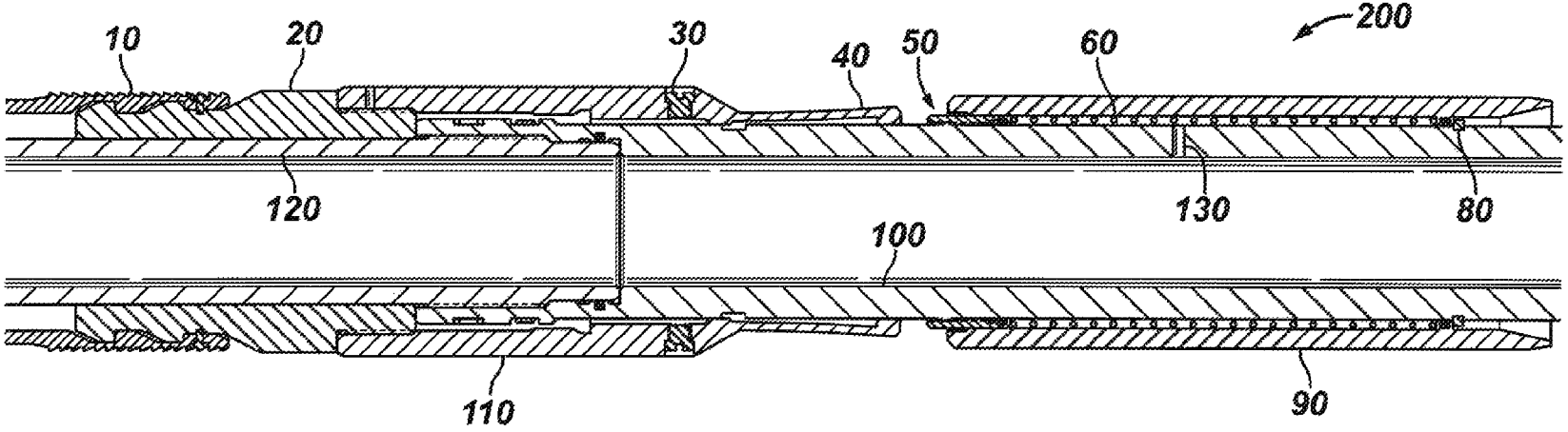
FIG. 3 is a drawing of an exemplary embodiment of an SPR packer as described herein.

In the embodiment shown in FIGS. 1-3, when the pressure below reaches some value sufficient to overcome the spring force (which is smaller than the threshold value to shear the screws), the holding collar 90 will be shifted towards the collet fingers 40 to contact and lock the collet fingers 40 into a groove in the bottom mandrel 100. After the collet fingers 40 are locked into the groove, the tensile force will go from the mandrel 120, bottom mandrel 100, gage ring 110, lower cone 20 to the anchors 10. The load path is taken around from the shear screws 30, so they are protected from the shear load when desirable.

In situations where the tensile force is less than the nominal shear strength of the shear screws, the protective mechanism need not necessarily be in place. For example, if the force is less than 95% of the shear force of the screws or less than 90% of the shear force of the screws or less than 85% of the shear force of the screws or less than 80% of the shear force of the screws or less than 75% of the shear force of the screws or less than 70% of the shear force of the screws or less than 65% of the shear force of the screws or less than 60% of the shear force of the screws or less than 55% of the shear force of the screws or less than 50% of the shear force of the screws.

When it is desirable to release the packer 200, the high pressure below the packer must first be bled off. As is shown in FIG. 2, the holding collar 90 shifts down by the force of spring 60. The tubing-annulus pressure differential may assist in shifting the holding collar 90 down (e.g., through port 130), but is not necessary. The shifted holding collar 90 causes collet fingers 40 to unlock. Once the collet fingers are unlocket, the forces are no longer routed around the shear screws, thus allowing shear force to shear the shear screws 30 and disengage the slips 10 allowing the packer to be retrieved. After the shear screws are sheared, the holding collar 90 may be shifted up as is shown in FIG. 3.

Figure 4:
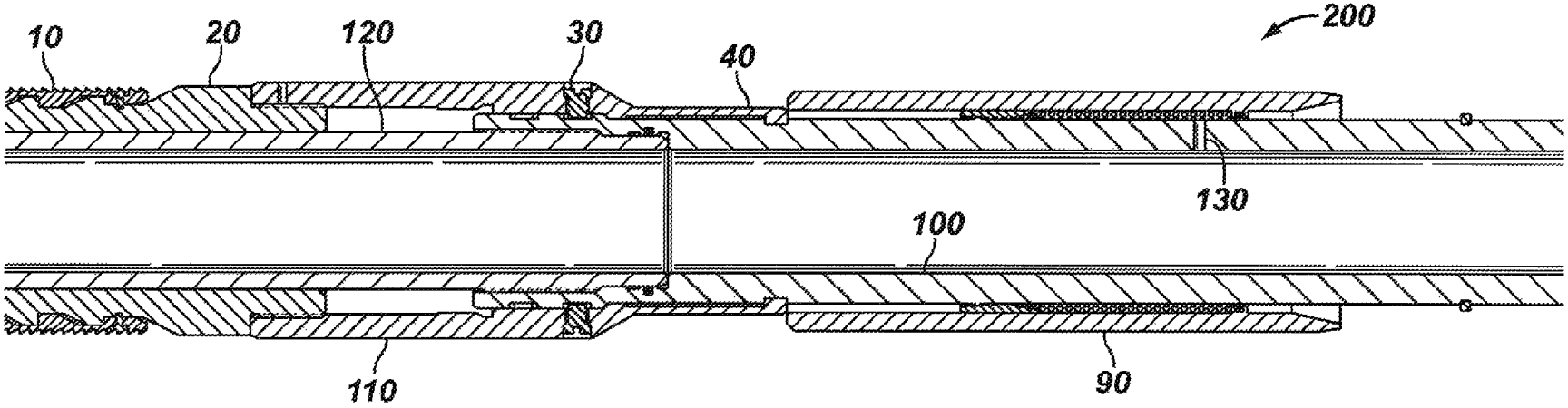
FIG. 4 is a drawing of another exemplary embodiment of an SPR packer as described herein.

With respect to FIG. 4, there is shown a further embodiment in accordance with the invention. In the embodiment of FIG. 4, the gage ring 110 is also equipped with a group of collet fingers. It works similarly to the embodiment described with respect to FIGS. 1-3, but holding collar 90 does not have a sleeve to hold collet fingers 40 into the groove. The locking mechanism of the embodiment of FIG. 4 relies on the hydrostatic force from the annulus-tubing pressure differential.

Figure 5:
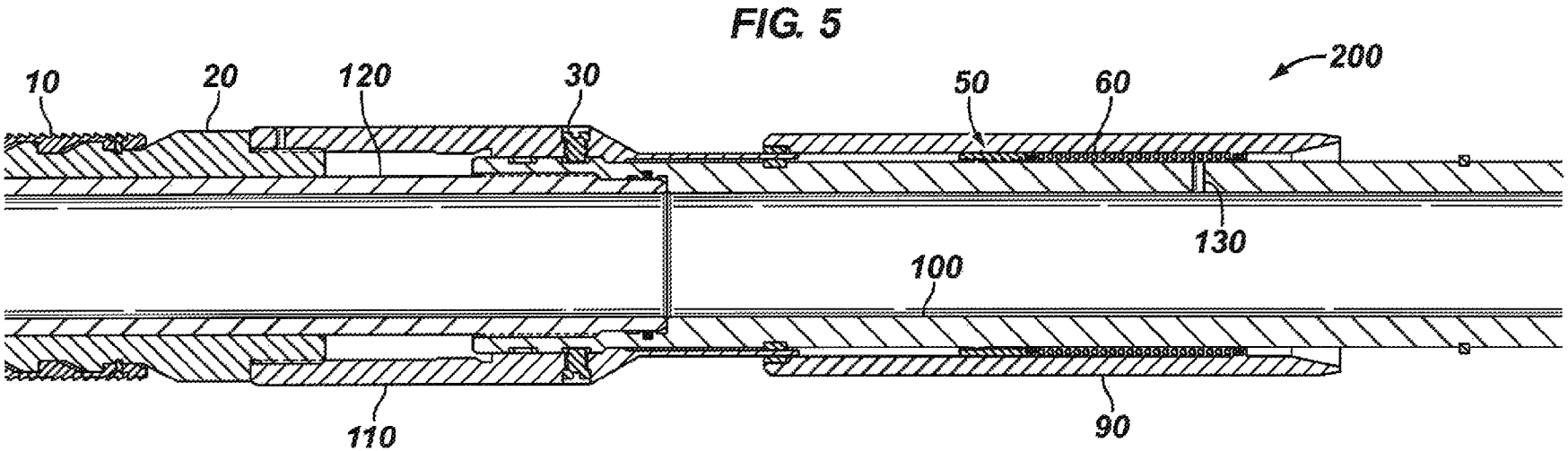
FIG. 5 is a drawing of another exemplary embodiment of an SPR packer as described herein.

With respect to FIG. 5, there is shown a further embodiment including a gage ring 110 that includes two or more locking segments and a holding collar 90 to hold the locking segments at the bottom mandrel groove. The holding collar 90 keeps the locking segments compressed when spring 60 is at its free length. In addition, the spring 60 is preferably an extension spring whose stiffness is preferably strong enough to withstand the force induced by the setting pressure and not to displace the holding collar so that the locking segments are released. It preferably also uses the tubing-annulus pressure differential to help retrieve the packer.

It is envisioned that in the SPR packer described herein that the mandrel 120 and bottom mandrel 100 may be two separate parts or combined into a single part.

The invention claimed is:

1. A mechanism for releasing a packer comprising:

a shear screw; and a means for isolating the shear screw from a shearing force, the means for isolating including collet fingers;

wherein the means for isolating is selectively unlockable to expose the shear screw to the force.

2. The mechanism of claim 1 wherein the means for isolating further comprises a collar which shifts to lock the collet fingers into a notch.

3. The mechanism of claim 2 wherein the collar is biased away from the collet fingers by a spring.

4. A method for releasing a set packer comprising:

unlocking a mechanism protecting at least one shear screw, the mechanism including collet fingers;

applying a shearing force to the at least one shear screw;

shearing the at least one shear screw.

5. The method of claim 4 wherein the mechanism further comprises a collar which shifts to lock the collet fingers into a notch.

6. The method of claim 5 wherein the collar is biased away from the collet fingers by a spring.

7. A method for retrieving a straight pull release packer, the method comprising:

unlocking a mechanism protecting at least one shear screw, the mechanism including collet fingers;

applying a shearing force to the at least one shear screw;

shearing the at least one shear screw; and retrieving the packer.

8. The method of claim 7 wherein the mechanism further comprises a collar which shifts to lock the collet fingers into a notch.

9. The method of claim 8 wherein the collar is biased away from the collet fingers by a spring.

* * * * *